US009671129B1

(12) United States Patent
Lu

(10) Patent No.: US 9,671,129 B1
(45) Date of Patent: Jun. 6, 2017

(54) UTILITY HEATING TABLE CABINET

(71) Applicant: Dong Guan Song Wei Electric Technology Co., Ltd., Dongguan (CN)

(72) Inventor: Weilin Lu, Dongguan (CN)

(73) Assignee: DONG GUAN SONG WEI ELECTRIC TECHNOLOGY CO., LTD., Dongguan, Guangdong (CN)

( * ) Notice: Subject to any disclaimer, the term of this patent is extended or adjusted under 35 U.S.C. 154(b) by 0 days.

(21) Appl. No.: 15/230,482

(22) Filed: Aug. 7, 2016

(30) Foreign Application Priority Data

Jan. 22, 2016 (CN) ..... 2016 1 0041770

(51) Int. Cl.

| | |
|---|---|
| ***A47B 77/08*** | (2006.01) |
| ***F24H 3/04*** | (2006.01) |
| ***A47B 37/00*** | (2006.01) |
| ***A47B 81/00*** | (2006.01) |

(52) U.S. Cl.
CPC ..... *F24H 3/0411* (2013.01); *A47B 37/00* (2013.01); *A47B 81/00* (2013.01); *A47B 2200/0066* (2013.01); *A47B 2200/0084* (2013.01); *A47B 2220/0091* (2013.01)

(58) Field of Classification Search
CPC .... A47B 2200/0066; A47B 2200/0084; A47B 2200/0091; A47B 37/00; A47B 81/00
USPC ..... 312/236
See application file for complete search history.

(56) References Cited

U.S. PATENT DOCUMENTS

| | | | | | |
|---|---|---|---|---|---|
| 2,485,880 | A * | 10/1949 | Hawkins | A47J 39/02 | 219/218 |
| 2,734,990 | A * | 2/1956 | Leuschner | A47B 21/06 | 219/218 |
| D292,152 | S * | 10/1987 | Meyers | D6/674 | |
| D292,251 | S * | 10/1987 | Meyers | D6/675 | |
| 5,308,156 | A * | 5/1994 | Gutierrez | F25D 19/00 | 312/236 |
| 5,360,374 | A * | 11/1994 | Wyon | F24F 13/0604 | 219/218 |
| 6,393,207 | B1 * | 5/2002 | Martin | F24C 7/004 | 362/806 |
| 2011/0109211 | A1 * | 5/2011 | Kirkeby | A47B 81/00 | 312/223.6 |
| 2012/0281974 | A1 * | 11/2012 | Gallo | F24B 1/18 | 392/365 |
| 2013/0327064 | A1 * | 12/2013 | Stein | A47B 37/00 | 62/3.6 |
| 2014/0355970 | A1 * | 12/2014 | Zhao | F24C 7/004 | 392/403 |
| 2015/0267922 | A1 * | 9/2015 | Lu | F24C 7/004 | 219/218 |

* cited by examiner

*Primary Examiner* — Daniel J Troy
*Assistant Examiner* — Timothy M Ayres
(74) *Attorney, Agent, or Firm* — Leong C. Lei

(57) ABSTRACT

A utility heating table cabinet includes a main body, which has a tabletop. The main body is provided, in the interior thereof, with a heating device at a location corresponding to and under the tabletop. The heating device includes a housing and a heating element and an air blower mounted inside the housing. The housing is formed with a heating airflow opening extending through an outer wall of the main body. The main body has a surface on which an operation panel is provided for controlling an operation condition of the heating device.

7 Claims, 9 Drawing Sheets

UTILITY HEATING TABLE CABINET

(a) TECHNICAL FIELD OF THE INVENTION

The present invention relates generally to the field of heating tables, and more particularly to a utility heating table cabinet.

(b) DESCRIPTION OF THE PRIOR ART

An electric heating table, when put into use, is free of flaming, exhaust gas, and high-frequency electromagnetic radiation, and is suitable for the elder, pregnant women, and children, making it widely used in various places, such as houses, offices, motels, accommodations, hotels, restaurants, and entertainment sites. However, the prior art heating tables are disadvantageous in having a complicated structure and a bulky overall size and being hard to operate and use.

Thus, it is urgently desired to have a novel technique that overcomes the above problems.

SUMMARY OF THE INVENTION

In light of the above, to overcome the drawbacks of the prior art, the present invention generally provides a utility heating table cabinet, which has a compact structure to help improve heating comfortableness and also exhibit advantages of being easy to operate and improved utilization.

To achieve the above object, the present invention adopts the following technical solution:

A utility heating table cabinet comprises a main body. The main body comprises a tabletop. The main body is provided, in an interior space thereof, with a heating device at a location corresponding to and under the tabletop. The heating device comprises a housing and a heating element and an air blower arranged inside the housing. The housing is formed with a heating airflow opening extending through an outer wall of the main body. The main body has a surface on which an operation panel is provided for controlling an operation condition of the heating device.

Compared to the prior art, the present invention possesses obvious advantages and beneficial effects. Specifically, it can be seen from the above described technical solution, the heating device is arranged under the tabletop to make the entire structure of the heating table cabinet reasonable and compact so that in use, warm airflows jets from the heating airflow opening to allow users to perceive the warm airflows thereby improving the comfortableness of warning, the design being more user-friendly, and advantages including easy operation and improve utilization being achievable.

The present invention provides an ingenious arrangement of the mounting structure of the heating device to ensure strength and stability of the mounting structure. In addition, under the condition of reasonable utilization of space, a spacing gap can be provide between the heating device and the tabletop so as to prevent the tabletop from causing negative influence resulting from localized over-heating.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
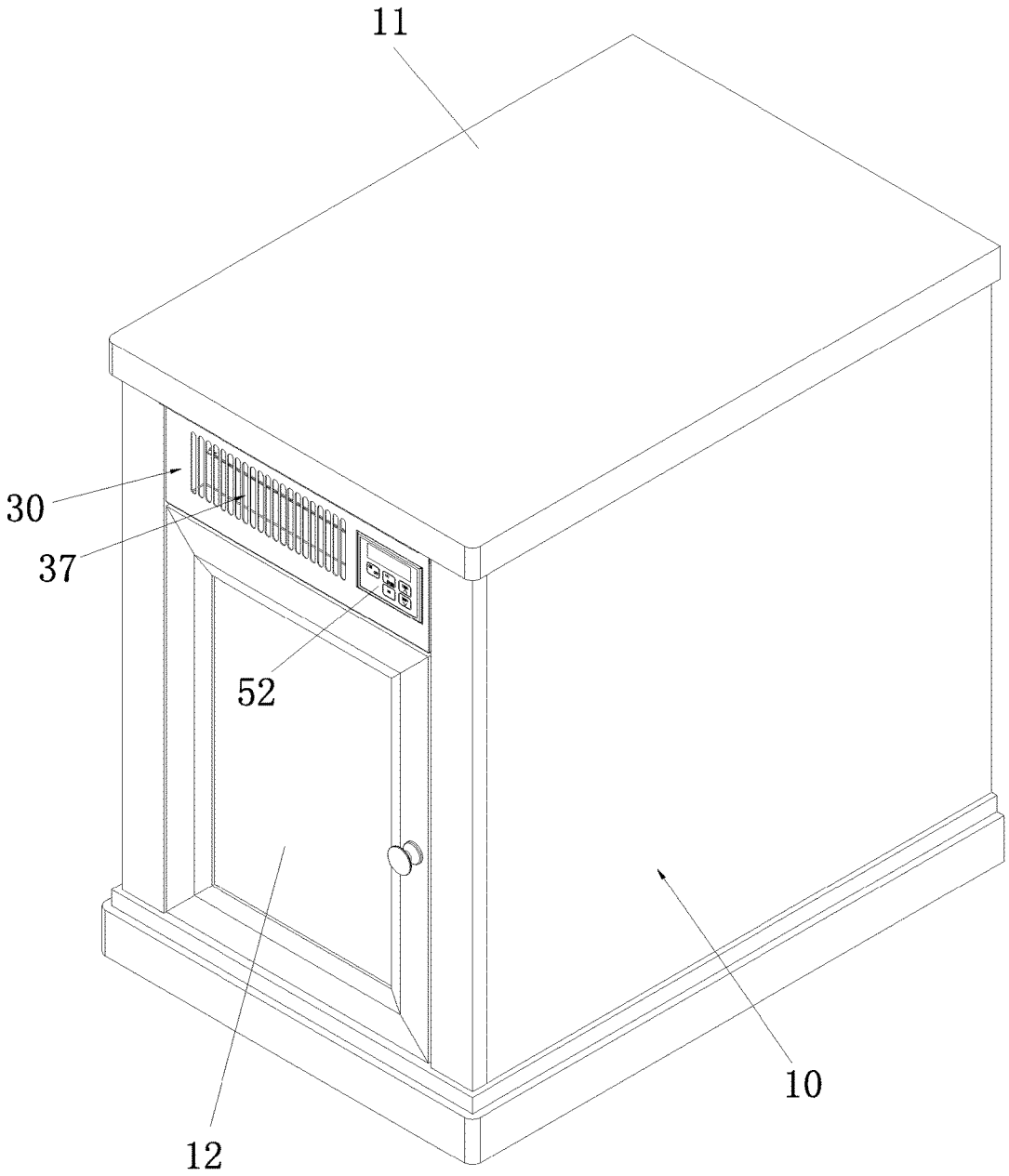
FIG. 1 is a perspective view showing a first embodiment of the present invention.
Figure 2:
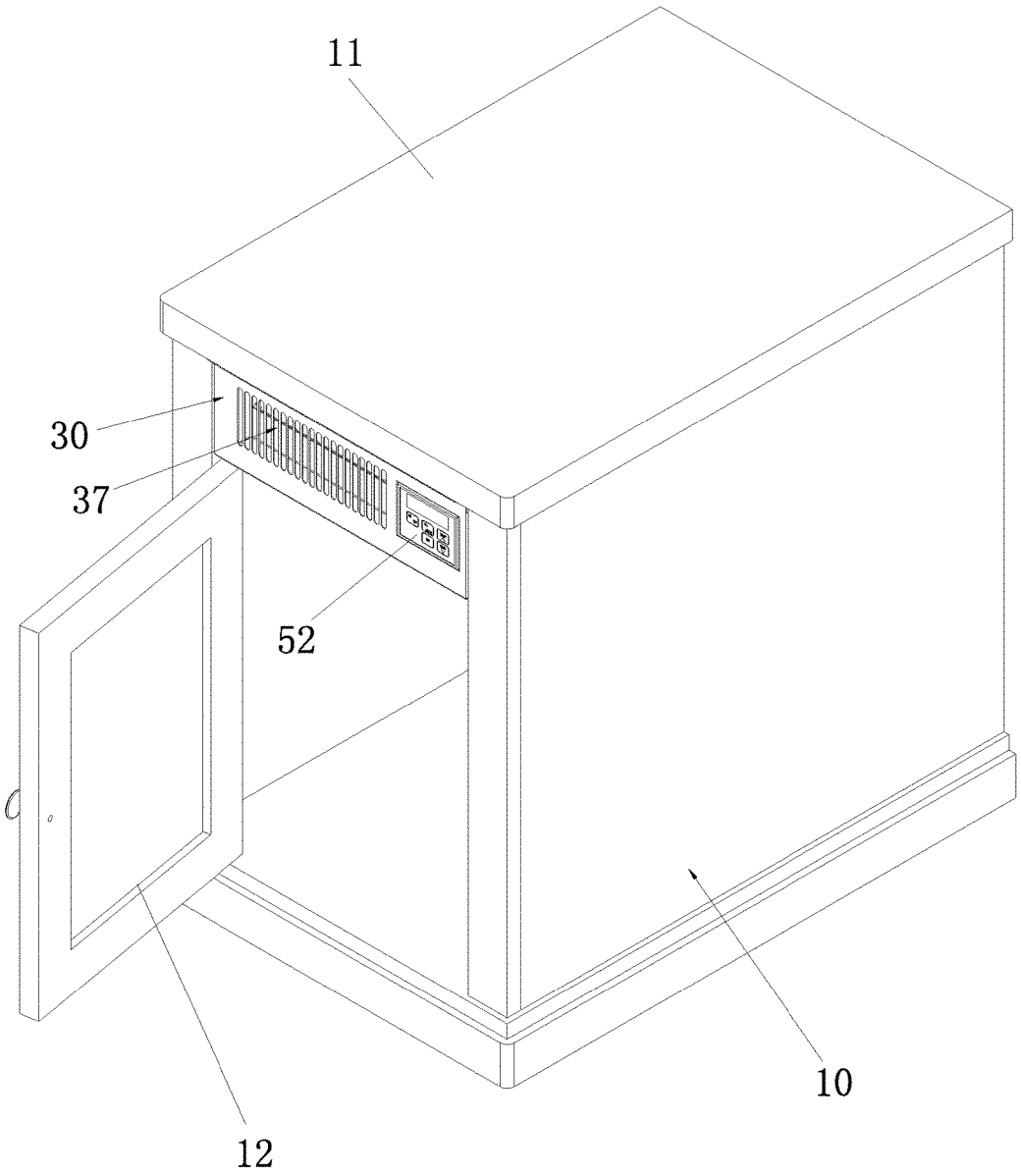
FIG. 2 is a perspective view showing the first embodiment of the present invention from a different angle (in a condition that a door is open).

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Referring to FIGS. 1-9, a structure of an embodiment of the present invention is shown and comprises a main body 10. The main body 10 comprises a tabletop 11. The main body 10 is provided, in an interior space thereof, with a heating device at a location corresponding to and under the tabletop 11, wherein the heating device comprises a housing and a heating element 21 (such as a heating filament, a quartz tube, or a PTC (Positive Temperature Coefficient) thermistor) and an air blower 22 arranged inside the housing. The housing is formed with heating airflow openings 37 extending through an outer wall of the main body 10. The heating airflow openings 37 are preferably formed in a side wall and/or a bottom wall of the housing. The main body 10 has a surface on which an operation panel is provided for controlling an operation condition of the heating device.

In the instant embodiment, the housing comprises a bottom box 30 and a top cover 40. The heating device is arranged in the bottom box 30. The top cover 40 is set on and covers and closes a top opening of the bottom box 30. The top cover 40 fixedly mounted to an underside of the tabletop 11. The air blower 22 comprises an air blower casing 23. The heating element 21 is mounted at an air egress opening of the air blower casing 23. The heating element 21 and the air blower 22 are assembled together as a unitary structure. The air blower casing 23 has a top fixedly mounted to an underside of the top cover 40. Here, the heating element 21 is mounted in a mounting frame 24. The mounting frame 24 is fixedly connected to the air blower casing 23. The mounting frame 24 has two ends each comprising an upper constraint section 241 and a lower constraint section 242 extending horizontally therefrom. For each of the two ends, the upper constraint section 241 and the lower constraint section 242 delimit therebetween a fitting space 243. The bottom box 30 is provided on an inside surface of a side wall thereof with positioning sections 301 respectively corresponding, in position, to the two ends such that the positioning sections 301 are each received in and fit into the corresponding one of the fitting spaces 243 with the upper constraint section 241 and the lower constraint section 242 respectively corresponding to and, perhaps, engage with upper and lower sides of the positioning section 301. In this way, through the positional arrangement among the upper constraint section 241, the lower constraint section 242, and the positioning section 301, assembling and positioning of the air blower 22 and the heating element 21 inside the housing can be achieved. Further, with the top of the air blower casing 23 being fixed to the underside of the top cover 40, a secured and sturdy fixing arrangement is achieved.

Figure 7:
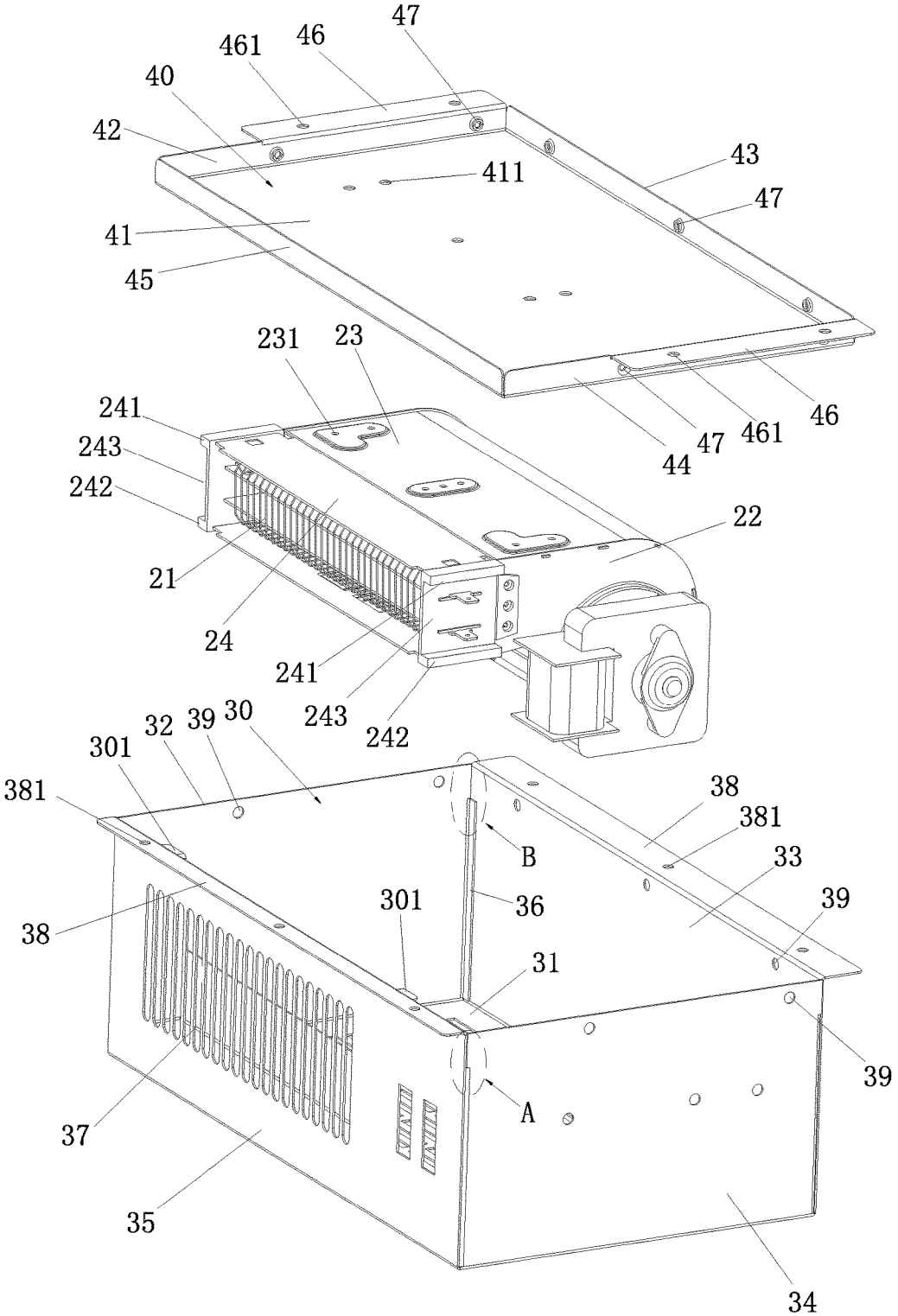
FIG. 7 is a view illustrating a top cover, a bottom box, a heater, an air blower, and a mounting seat of FIG. 6 in an enlarged form.
Figure 8:
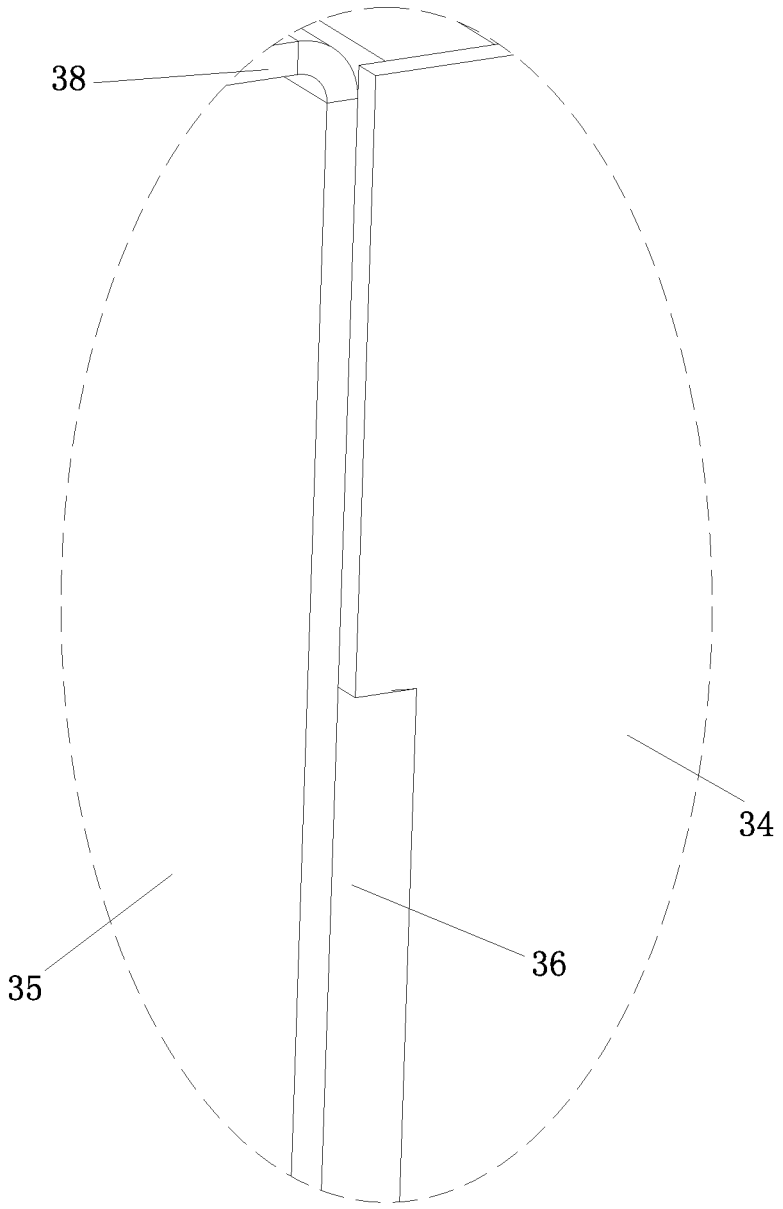
FIG. 8 is an enlarged view of portion A of FIG. 7.
Figure 9:
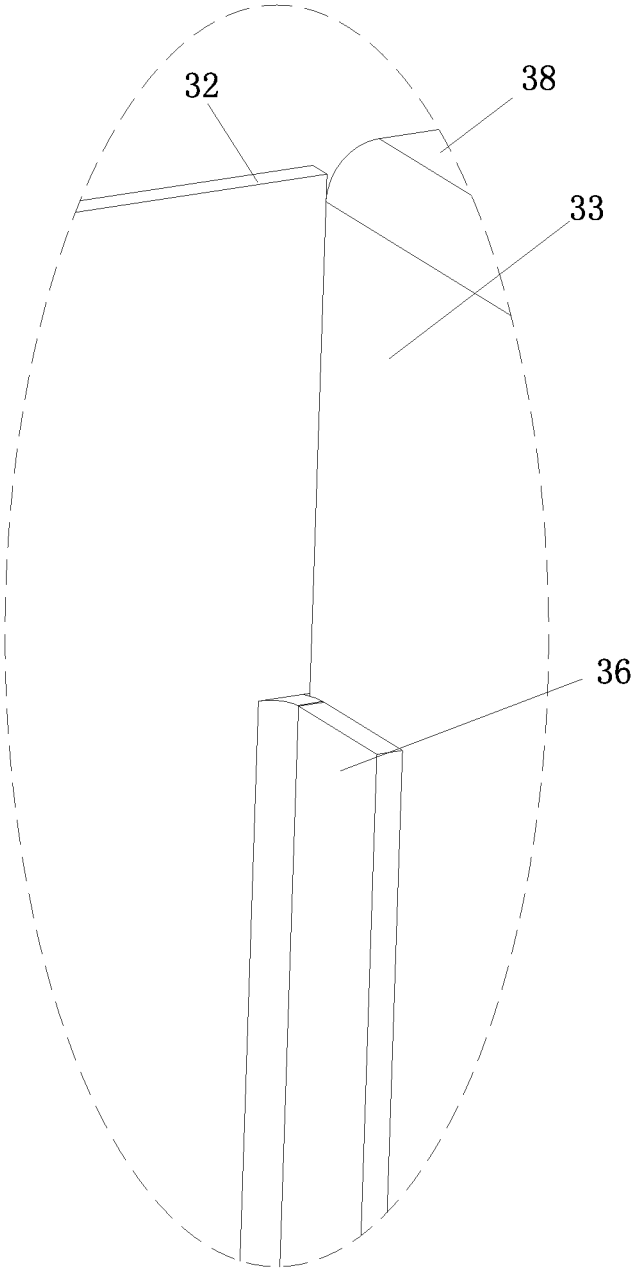
FIG. 9 is an enlarged view of portion B of FIG. 7.

Referring to FIGS. 7-9, in the instant embodiment, a preferred structural arrangement of the top cover 40 and the bottom box 30 is as follows.

The top cover 40 comprises a base plate section 41 and a first sink section 42, a second sink section 43, a third sink section 44, and a fourth sink section 45 respectively and integrally extending upward from four edges of a rectangular shape of the base plate section 41, wherein the first sink section 42 and the third sink section 44 are arranged at two opposite sides and the second sink section 43 and the fourth sink section 45 are arranged at another two opposite sides. The first sink section 42 and the third sink section 44 have top edges that are integrally bent and extend outward to each form a first horizontal connection plate 46. The first horizontal connection plate 46 is formed with first coupling holes 461, so that the top cover 40 is fixedly mounted to the underside of the tabletop 11 through the first coupling holes 461. The base plate section 41 is formed with second coupling holes 411. The heating device is provided with a mounting seat that is formed with third coupling holes 231. The heating device is securely mounted by means of the third coupling holes 231 to the second coupling holes 411 of the base plate section 41. The first sink section 42, the second sink section 43, and the third sink section 44 are each provided with fourth coupling holes 47.

The bottom box 30 comprises a bottom board section 31 and a first side board section 32, a second side board section 33, a third side board section 34, and a fourth side board section 35 respectively and integrally extending upward from four edges of the bottom board section 31, wherein the fourth side board section 35 and the bottom board section 31 are each formed with ventilation holes. The first side board section 32 and the third side board section 34 each have two side edges that are integrally bent and extended toward the second side board section 33 and the fourth side board section 35 to form positioning connection plates 36 such that the positioning connection plate 36 are positioned against inside surfaces thereof corresponding to the second side board section 33 or the fourth side board section 35 (also see FIGS. 7, 8, and 9). It is noted here that the positioning connection plates 36 are each extending along a part of the corresponding side edge such that an upper portion of the side edge has no such bending. In this way, the upper portion of the side edge can be positioned against a corresponding end of the second side board section 33 or the fourth side board section 35 adjacent thereto. The second side board section 33 and the fourth side board section 35 each have a top edge that is integrally bent and extends outward to form a second horizontal connection plate 38. The second horizontal connection plate 38 is formed with fifth coupling holes 381 such that the bottom box 30 is fixedly connected by means of the fifth coupling holes 381 to the underside of the tabletop 11. The first side board section 32, the second side board section 33, and the third side board section 34 are all formed with sixth coupling holes 39.

The base plate section 41 and the first sink section 42, the second sink section 43, the third sink section 44, and the fourth sink section 45 of the top cover 40 are all received in the interior space of the bottom box 30. The fourth coupling holes 47 are connected to the sixth coupling holes 39 respectively. The second horizontal connection plates 38 of the bottom box 30 extend outward from the second sink section 43 and the fourth sink section 45 of the top cover 40. In this way, separation of the heating device and the tabletop 11 from each other by a spacing gap therebetween can be realized to prevent the tabletop 11 from causing adversely influence resulting from localized over-heating.

Figure 3:
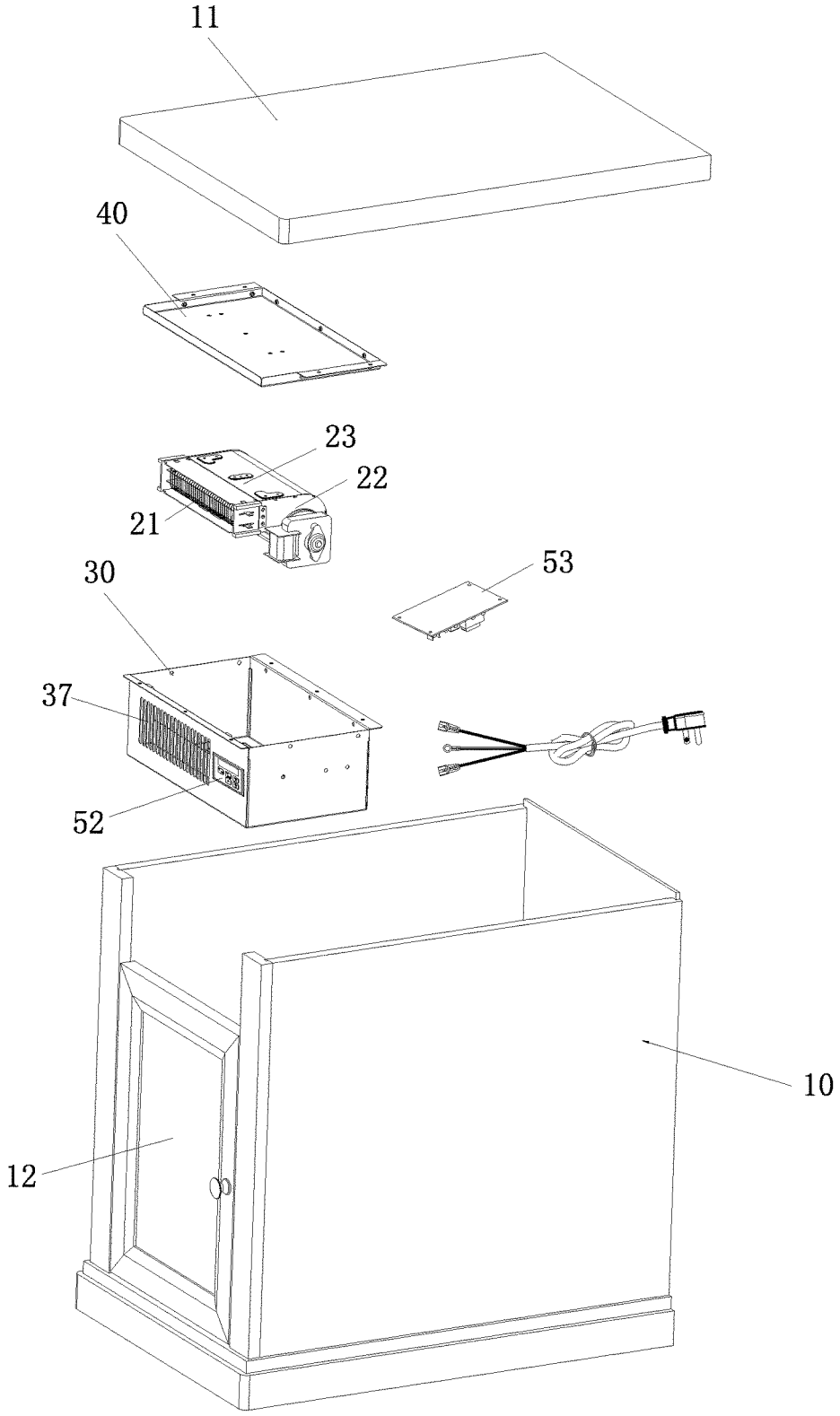
FIG. 3 is an exploded view of the first embodiment of the present invention.
Figure 4:
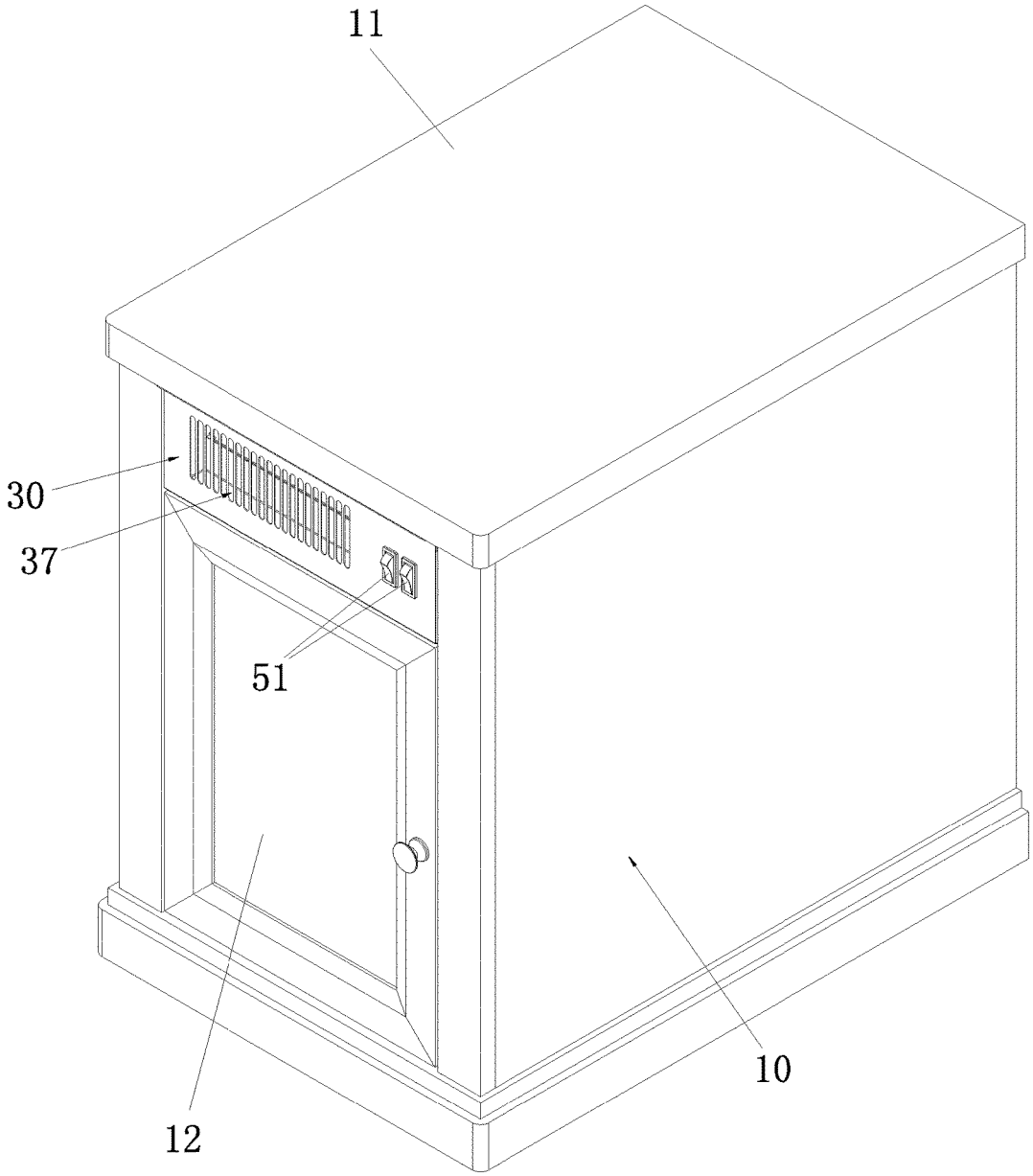
FIG. 4 is a perspective view showing a second embodiment of the present invention.
Figure 5:
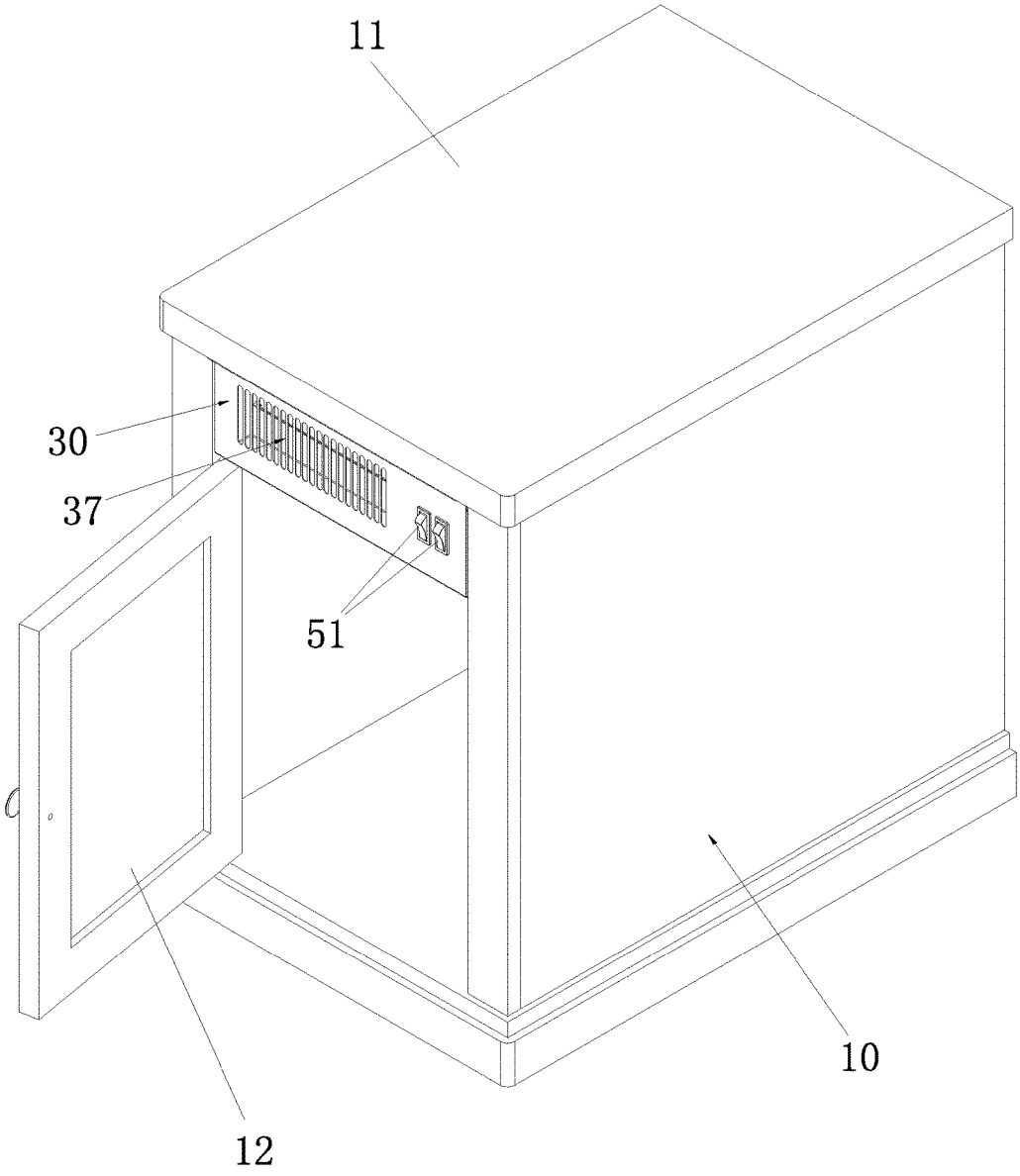
FIG. 5 is a perspective view showing the second embodiment of the present invention from a different angle (in a condition that a door is open).
Figure 6:
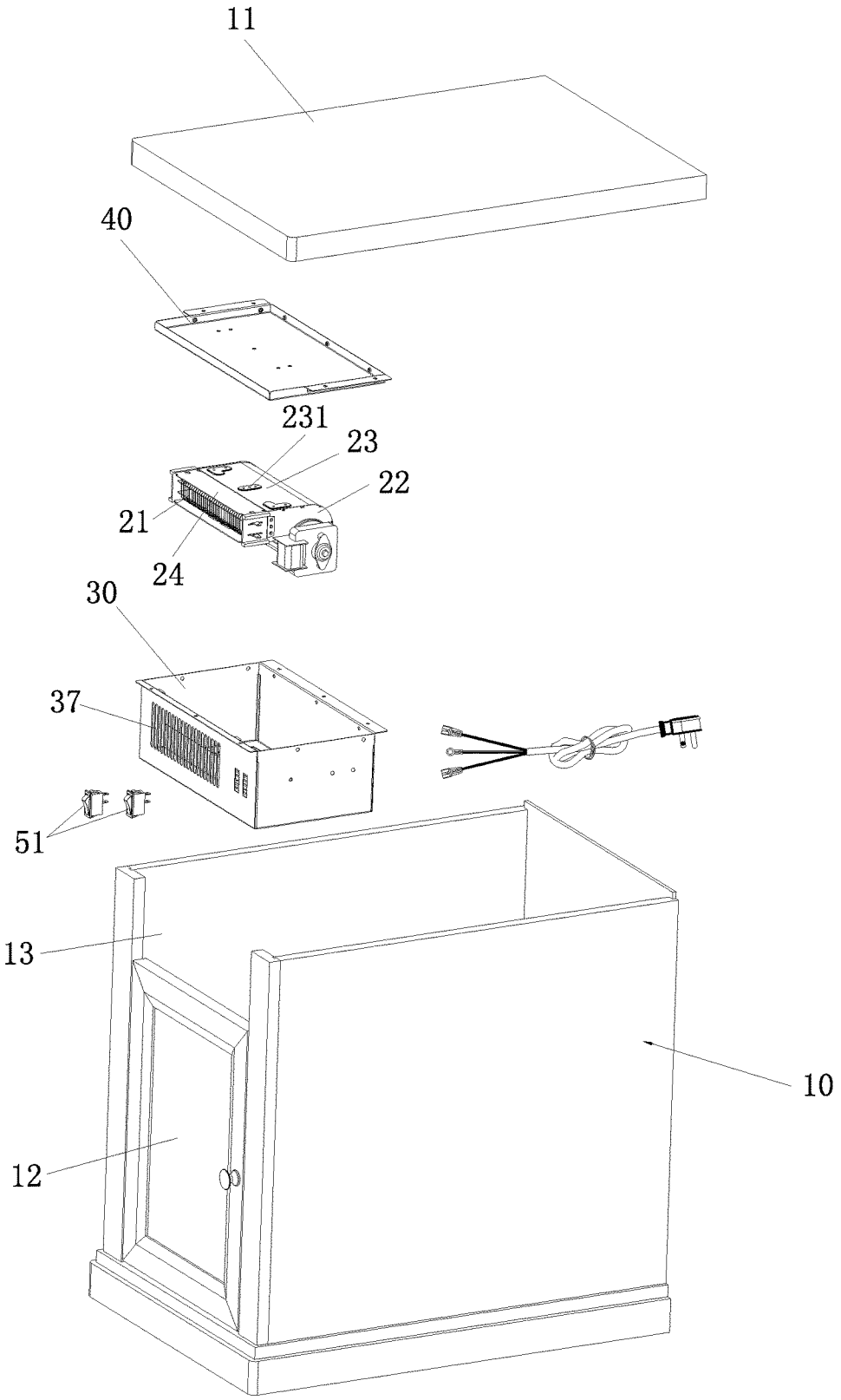
FIG. 6 is an exploded view of the second embodiment of the present invention.

Comparison between FIGS. 3 and 6 shows a major difference between the first and second embodiments resides in the control panels. Usually, the operation panel is arranged on a side surface of the main body 10 (here, the side surface referring to the four lateral sides of the main body 10, including the front side, the left side, the right side, and the rear side). The two embodiments described herein both provide an arrangement that the operation panel is mounted on the front side or front surface of the main body 10 and the entirety of the main body 10 is configured in left-right symmetry. An upper portion of the front surface of the main body 10 is formed with an avoidance opening 13 such that the heating device is, partly, arranged in the avoidance opening 13 with the heating airflow openings 37 thereof set on the front side of the housing and the operation panel thereof being also arranged on the front surface of the housing, where the heating airflow openings 37 and the operation panel both correspond to and are exposed through the avoidance opening 13.

In FIG. 3, the operation panel comprises a touch switch 51 such that control of the heating device 51 is achieved through activating or pressing down the touch switch 51. In FIG. 6, the operation panel comprises a touch panel 52 and a main control board 53, which are operable through a touch control manner so that the main control board 53 may control the operation of the heating device. Control of the heating device as described herein may include turning on/off the heating device and regulating heating power (where the touch control fashion operation can be used in combination with digital reading or figure of temperature).

Here, the main body 10 can be a wooden body 10, a plastic body 10, or a metal body 10. The main body 10 is set at a location corresponding to and under the tabletop 11. The four sides of the main body 10 can be made open, or alternatively, as shown in FIGS. 1, 2, 4, and 5, the main body 10 is set at a location corresponding to and under the tabletop 11 and the front surface of the main body 10 is provided with an openable/closable door panel 12, while the remaining three sides of the main body 10 are closed. The main body 10 has a bottom that is provided with a flat panel like bottom support board, or the bottom of the main body 10 can be provided with support legs that are arranged in a spaced manner.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. A utility heating table cabinet, comprising main body, the main body comprising a tabletop, the main body being provided, in an interior space thereof, with a heating device at a location corresponding to and under the tabletop, the heating device comprising a housing and a heating element and an air blower arranged inside the housing, the housing being formed with heating airflow openings extending through an outer wall of the main body, the main body having a surface on which an operation panel is provided for controlling an operation condition of the heating device, wherein the housing comprises a bottom box and a top cover, the heating device being arranged in the bottom box, the top cover being set on and covering a top opening of the bottom box, the top cover being fixedly connected to an underside of the tabletop, the air blower comprises an air blower casing, and the heating element is mounted at an air egress opening of the air blower casing, the heating element and the air blower being assembled together as a unitary structure, the air blower casing having a top fixedly mounted to an underside of the top cover, the top cover comprises a base plate section and a first sink section, a second sink section, a third sink section, and a fourth sink section respectively and integrally extending upward from four edges of a rectangular shape of the base plate section, wherein the first sink section and the third sink section are arranged at two opposite sides and the second sink section and the fourth sink section are arranged at another two opposite sides, the first sink section and the third sink section have top edges that are integrally bent and extend outward to each form a first horizontal connection plate, the first horizontal connection plate being formed with first coupling holes, so that the top cover is fixedly mounted to the underside of the tabletop through the first coupling holes, the base plate section is formed with second coupling holes, the heating device being provided with a mounting seat that is formed with third coupling holes, the heating device is securely mounted by means of the third coupling holes to the second coupling holes of the base plate section; and the first sink section, the second sink section, and the third sink section are each provided with fourth coupling holes, the bottom box comprises a bottom board section and a first side board section, a second side board section, a third side board section, and a fourth side board section respectively and integrally extending upward from four edges of the bottom board section; the second side board section and the fourth side board section have top edges that are integrally bent and extend outward to each form a second horizontal connection plate, the second horizontal connection plate being formed with fifth coupling holes, the bottom box being fixedly connected by means of the fifth coupling holes to the underside of the tabletop; and the first side board section, the second side board section, the third side board section are each formed with sixth coupling holes, and the base plate section and the first sink section, the second sink section, the third sink section, the fourth sink section of the top cover are received in an interior space of the bottom box, the fourth coupling holes being connected to the sixth coupling holes respectively, and the second horizontal connection plates of the bottom box extend outwards from the second sink section and the fourth sink section of the top cover.

2. The utility heating table cabinet according to claim 1, wherein the heating element is mounted in a mounting frame, the mounting frame being fixedly connected to the air blower casing, the mounting frame having two ends each comprising an upper constraint section and a lower constraint section extending horizontally therefrom such that for each of the two ends, the upper constraint section and the lower constraint section delimit therebetween a fitting space, the bottom box being provided on an inside surface of a side wall thereof with positioning sections respectively corresponding, in position, to the two ends such that the positioning sections are each received in and fit into the corresponding one of the fitting spaces with the upper constraint section and the lower constraint section respectively corresponding to upper and lower sides of the positioning section.

3. The utility heating table cabinet according to claim 1, wherein the first side board section and the third side board section each have two side edges that are integrally bent and extended toward the second side board section and the fourth side board section to form positioning connection plates such that the positioning connection plate are positioned against inside surfaces thereof corresponding to the second side board section or the fourth side board section.

4. The utility heating table cabinet according to claim 1, wherein the main body is one of a wooden body, a plastic body, and a metal body; the heating element comprises one of a heating filament, a quartz tube, and a PTC (Positive Temperature Coefficient) thermistor; and the operation panel is arranged on a side surface of the main body, the operation panel comprising a touch switch, or alternatively, the operation panel comprising a touch panel and a main control board.

5. The utility heating table cabinet according to claim 1, wherein the heating airflow opening of the housing is formed in formed in a side surface or a bottom surface of the housing; the main body is arranged at a location under the tabletop and the main body has four sides that are open; or, alternatively, the main body is arranged at a location under the tabletop and the main body has a front side that is provided with an openable/closable door panel, remaining three sides of the main body being closed.

6. The utility heating table cabinet according to claim 1, wherein the main body has a bottom that is provided with a flat panel like bottom support board, or the bottom of the main body is provided with support legs that are arranged in a spaced manner.

7. The utility heating table cabinet according to claim 1, wherein a front side of the main body is provided, in an upper portion thereof, with an avoidance opening, the heating device being arranged in the avoidance opening with the heating airflow opening corresponding to and exposure through the avoidance opening; the entirety of the main body is of a left-right symmetric configuration.

* * * * *